US010843212B2

(12) United States Patent
Fairchild

(10) Patent No.: US 10,843,212 B2
(45) Date of Patent: Nov. 24, 2020

(54) PRESSURE WASHER AND A METHOD OF PROVIDING A SUPER-HEATED JET OF WATER

(71) Applicant: Restorative Techniques Ltd, South Gloucestershire (GB)

(72) Inventor: Jamie Aelfred Fairchild, South Gloucestershire (GB)

(73) Assignee: Restorative Techniques LTD, South Gloucestershire (GB)

( * ) Notice: Subject to any disclaimer, the term of this patent is extended or adjusted under 35 U.S.C. 154(b) by 230 days.

(21) Appl. No.: 15/741,405

(22) PCT Filed: Jun. 28, 2016

(86) PCT No.: PCT/GB2016/051936
§ 371 (c)(1),
(2) Date: Jan. 2, 2018

(87) PCT Pub. No.: WO2017/006080
PCT Pub. Date: Jan. 12, 2017

(65) Prior Publication Data

US 2018/0369841 A1 Dec. 27, 2018

(30) Foreign Application Priority Data

Jul. 4, 2015 (GB) ..... 1511747.6

(51) Int. Cl.
*B05B 9/00* (2006.01)
*B05B 9/04* (2006.01)
(Continued)

(52) U.S. Cl.
CPC ..... *B05B 9/002* (2013.01); *B05B 9/005* (2013.01); *B05B 9/007* (2013.01); *B05B 9/01* (2013.01);
(Continued)

(58) Field of Classification Search
CPC ..... B05B 9/002
See application file for complete search history.

(56) References Cited

U.S. PATENT DOCUMENTS

| | | | | |
|---|---|---|---|---|
| 6,029,589 | A | 2/2000 | Simpson | |
| 2006/0219263 | A1 | 10/2006 | Friedheim | |
| 2011/0041782 | A1* | 2/2011 | Vaughan | A01M 21/04 122/451 R |

FOREIGN PATENT DOCUMENTS

| | | | |
|---|---|---|---|
| DE | 102004052198 | A1 | 4/2006 |
| GB | 2487364 | A | 7/2012 |
| WO | 2008/030799 | A2 | 3/2008 |

OTHER PUBLICATIONS

International Searching Authority, International Search Report, PCT/GB2016/051936, dated Oct. 12, 2016.
(Continued)

*Primary Examiner* — Jason Y Ko
(74) *Attorney, Agent, or Firm* — Reichel Stohry Dean LLP; Mark C. Reichel; Natalie J. Dean

(57) ABSTRACT

Some pressure washers include units for introduction of detergents and other chemicals into the water stream; however, it is desirable to obtain sterilized cleaning water without them, such that use in, for instance, food preparation processes can be implemented. With a sufficiently high temperature super-heated water stream, all process equipment, including pipework, that comes into contact with sterile process materials, can be cleaned, de-greased and sterilized both with the spray jet using water alone whilst not contributing endotoxins, microbial contamination or particles. Merely raising the temperature of water in a conventional pressure washer could cause components to fail, if they were not designed to operate at such high temperatures. In the present invention, the pump (25) supplies a relatively low volume of water at a relatively high pressure to the
(Continued)

boiler (13), allowing the boiler (13) to heat that volume of water to a relatively high temperature. In contrast, if a higher volume of water were desired over a given time period, the pump would have to supply it at a comparatively lower pressure (which is undesirable) and/or the boiler would only be able to heat it to a comparatively lower temperature over that same time period (which is also undesirable). Increased working temperatures on a hose (3) will reduce its maximum working pressure; however, by using a PTFE hose as in the present invention, the maximum working pressure at 170 degrees may be up to 17 MPa.

9 Claims, 1 Drawing Sheet

(51) Int. Cl.

| | |
|---|---|
| ***B08B 3/02*** | (2006.01) |
| ***B05B 9/01*** | (2006.01) |
| ***B05B 15/18*** | (2018.01) |

(52) U.S. Cl.
CPC ..... *B05B 9/0403* (2013.01); *B05B 15/18* (2018.02); *B08B 3/02* (2013.01); *B08B 3/026* (2013.01); *B08B 2203/007* (2013.01); *B08B 2230/01* (2013.01)

(56) References Cited

OTHER PUBLICATIONS

International Searching Authority, Written Opinion of the International Searching PCT/GB2016/051936, dated Oct. 12, 2016.
Fairchild, Jamie N., "Technical Information Sheet, The Thermatech 'Superheated Water' System," https://www.restorative-products.com/uploads/technical-information-sheet-thermatech-system-expanded.pdf, Retrieved Oct. 4, 2016.

* cited by examiner

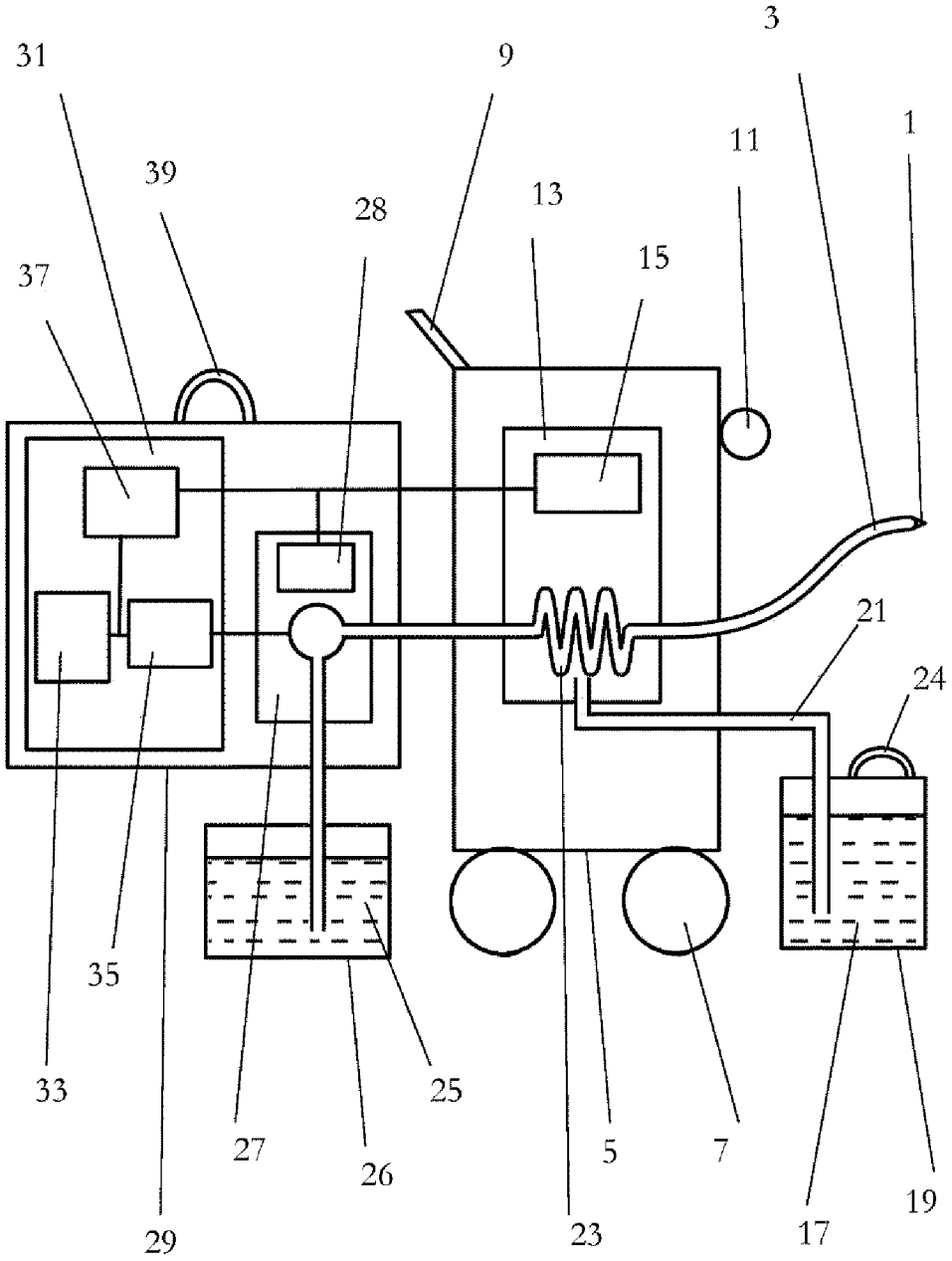
31
39
37
28
9
13
15
11
3
1
21
24
35
33
29
27
26
25
23
5
7
17
19

PRESSURE WASHER AND A METHOD OF PROVIDING A SUPER-HEATED JET OF WATER

PRIORITY

The present application is related to, and claims the priority benefit of, and is a 35 U.S.C. 371 national stage application of, International Patent Application Serial No. PCT/GB2016/051936, filed Jun. 28, 2016, which is related to, and claims the priority benefit of, Great Britain Patent Application Serial No. 1511747.6, filed Jul. 4, 2015. The contents of each of these applications are hereby incorporated by reference in their entirety into this disclosure.

TECHNICAL FIELD

The present invention relates generally to a pressure washer and a method of providing a super-heated jet of water.

BACKGROUND

Pressure washers are routinely used cleaning masonry and removing paint/coatings on heritage and other structures, and are also used in many commercial, agricultural and industrial applications, including for instance cleaning down and sterilizing of dairies, veterinary practices and health centres.

Some pressure washers include units for introduction of detergents and other chemicals into the water stream; however, it is desirable to obtain sterilized cleaning water without them, such that use in, for instance, food preparation processes can be implemented. With a sufficiently high temperature super-heated water stream, all process equipment, including pipework, that comes into contact with sterile process materials, can be cleaned, de-greased and sterilized both with the spray jet using water alone whilst not contributing endotoxins, microbial contamination or particles. However, attempting to provide pressurized hot water stream may have its own difficulties.

Merely raising the temperature of water in a conventional pressure washer could cause components to fail, if they were not designed to operate at such high temperatures. A new design of pressure washer is therefore required that allows higher temperature jet of super-heated water to be supplied.

BRIEF SUMMARY

According to a first aspect of the present invention, there is provided a pressure washer, for providing a super-heated jet of water, the pressure washer comprising: a water pump configured to provide at most 20 litres of water per minute at greater than 15 MPa to an output thereof; a boiler arranged to receive pressurised water from the output of the water pump, the boiler configured to heat the pressurised water with a power of at least 75 kW to a temperature of at least 155 degrees centigrade; a hose for conveying the super-heated pressurised water from the boiler, wherein the hose comprises a PTFE lining; and a nozzle connected to the hose and configured to produce a shaped liquid spray jet of super-heated water.

The pump supplying a relatively low volume of water at a relatively high pressure to the boiler allows the boiler to heat that volume of water to a relatively high temperature. In contrast, if a higher volume of water were desired over a given time period, the pump would have to supply it at a comparatively lower pressure (which is undesirable) and/or the boiler would only be able to heat it to a comparatively lower temperature over that same time period (which is also undesirable).

The water pump may be configured to provide at most 15, 12, 10 or 9.5 litres of water per minute. The water pump may be configured to provide water at a pressure of at least 16 or 17 MPa. The water pump may be a 1, 2, 3 or 4 piston pump, which may run between 1000 and 3000 rpm, in particular between 1300 and 2000 rpm, more particularly between 1400 and 1700 rpm, for instance at approximately 1450 rpm; however, other configurations of pump are contemplated. For instance, each piston may have a volume of between 1 and 6 cc, in particular between 1.5 cc and 3 cc, for instance 2 cc.

The pump may have an inlet for water, at which is attached an input to the pump, which may comprise a ¾ inch BSP ('British Standard Pipe') screw connection (e.g.: thread pitch: approximately 1.814 mm; thread major diameter: approximately 26.441 mm; thread minor diameter: approximately 24.120 mm; as described in ISO-7) to which either a hose pipe can be connected, or an air tight claw coupling; however, other types of input connector may be used (including other sizes of BSP screw connection). This allows the pump to draw water from a static source such as a tank or stream located within 10 metres horizontally.

The working pressure of the water may be controlled by an unloader valve, and may be selectable over a range of pressures up to 15.5, 16, 16.5, 17, 17.5 or 18 MPa. The unloader valve controls the proportion of water that exits the pump to be sent to the boiler to that to be re-circulated back into its inlet. If a greater proportion of water is sent to the boiler, it is supplied at a higher pressure. A gauge may be provided adjacent to the unloader valve to display the proportion and/or the pressure. The pump's output may comprise a first outlet that supplies pressurised water to the boiler, and may comprise a second outlet controlled by a selection valve, the second outlet being usable for depressurizing the high pressure from the first outlet to the boiler, to couple a second boiler thereto (for instance to supply a second nozzle) and/or to expel any air in the pump during the 'priming' stage when sucking water from a static source.

The boiler may be configured to heat the pressurised water with a power of at least 85, 90, 95 or 100 kW. The boiler may be configured to heat the pressurised water to a temperature of at least 160, 165 or 170 degrees centigrade.

The boiler may be configured to operate with one or more fuels selected from red diesel, white diesel, bio-fuels including cooling oil, kerosene, and similar fuels.

Fuel may be introduced into the combustion chamber by a fuel jet, and may be ignited therein. The boiler may comprise a fan for introducing air into the combustion chamber in which the fuel is burned. Fuel flow into the combustion chamber may be controlled via a fuel valve.

The boiler may have a stainless steel casing. The boiler may have a double walled jacket casing, configured such that air flow from a fan passes within the jacket of the casing. This minimises the heat transfer to the outside casing of the boiler, which provides a safety benefit as well as raising efficiency because lost heat is re-circulated and maintained within the unit. In particular, the air may be introduced into the burning region via the jacket, such that the air is pre-warmed.

The boiler may comprise a heat exchanger. The pressurised water may flow through a tube (which may be coiled) that is in the combustion chamber with the flame.

The boiler may comprise an on-off switch. The on-off switch may only stay latched in the on position if the voltage to the boiler is above some threshold voltage, for instance approximately 5, 10, 15 or 20 V. In this way, the boiler will switch off when insufficient power is being supplied.

The boiler may comprise a temperature controller configured to allow an operator to select a working temperature of the machine, up to at least (or approximately) 160, 165 or 170 degrees centigrade. The temperature controller may be a digital controller or an analogue thermostat. The boiler may be configured to maintain the selected temperature by starting and stopping (or increasing and decreasing/limiting/reducing) the fuel flow into the combustion chamber. The boiler may comprise a temperature sensor; in particular the temperature controller may comprise a temperature sensor. The digital temperature controller may have a hysteresis control; that is, the temperature at which fuel flow to the combustion chamber is started/increased is lower than the temperature at which fuel flow to the combustion chamber is stopped/decreased/limited/reduced by a predetermined amount. The predetermined amount may be 1, 2, 3, 4 or 5 degrees centigrade. This maintains a very accurate and smooth control of water temperature; a large fluctuation of temperature can not only be inefficient of fuel consumption, but also to the progress of work with the spray jet cycling between sharp and diffuse.

By limiting the pressure of water from the pump, and therefore the volume of water from the pump entering the boiler, the rate of water flow through the heat exchanger is kept correspondingly low. This allows the boiler to heat the water over a longer period of time, and therefore to achieve a relatively high temperature (e.g. up to 170 degrees centigrade). With the water being under high pressure compared to atmosphere, the water is not able to expand into steam, therefore heat from the boiler must raise the water's temperature above normal atmospheric boiling point, instead of being used to contribute to the heat of vaporization, therefore it stays in its liquid state above 100 degrees centigrade.

The hose may be a flexible hose. The hose may have an internal bore of between 7 mm and 9 mm, in particular between 7.5 mm and 8.5 mm, for instance approximately 8 mm.

Increased working temperatures on a hose will reduce its maximum working pressure. For each increase in temperature of 1 degree centigrade above 130 degrees centigrade, the maximum working pressure of a hose is reduced by approximately 0.75%. Therefore, at a temperature of 170 degrees centigrade, the maximum working pressure of a hose may be reduced by approximately 30%. By using a PTFE hose as in the present invention, the maximum working pressure at 170 degrees may be up to 17, 18, 19 or 20 MPa.

The nozzle may be configured to project a flat fan spray; however, other shapes of spray are also contemplated. The fan may have a spray angle between 0 degrees and 60 degrees, in particular between 10 degrees and 50 degrees, more particularly between approximately 15 degrees and 40 degrees, for instance 15, 25 or 40 degrees.

The nozzle may comprise ceramic, tungsten, silicon carbide, boron carbide or other similar material. In particular the nozzle may comprise a material having a hardness substantially greater than that of steel and/or plastics materials. In this way, effects due to the relatively high temperatures and pressures encountered by the nozzle may be mitigated. Specifically, if a relatively malleable material were used to form the nozzle, the high-pressure super-heated water would deform the nozzle in a relatively short time. For instance, plastics material may be deformed within a time on the order of 1-2 seconds of use, and a steel nozzle may be deformed within a time on the order of 1-2 hours of use.

The nozzle may comprise a type '03', '034', '035' or '04' nozzle. The standard nozzle 'type' is defined as 10 or 100 times the flow of water (measured in US gallons per minute) at a water pressure of 40 psi (equivalent to approximately 0.276 MPa). An alternative nozzle type is defined as 10 times the flow of water (measured in US gallons per minute) at a water pressure of 40 psi (equivalent to approximately 0.276 Mpa), and so the nozzle may be of type '3.0', '3.25', '3.5', '3.75' or '4.0'. A US gallon is equivalent to approximately 3.785 litres. Therefore, the nozzle may be configured to permit a flow of water at a water pressure of 0.275 MPa of between 1.1 litres per minute and 1.5 litres per minute, in particular between 1.2 and 1.4 litres per minute, more particularly approximately 1.3 litres per minute. The nozzle may have an orifice with a diameter of between 1.1 mm and 1.4 mm, in particular between 1.2 mm and 1.3 mm, more particularly approximately 1.3 mm.

In this way, the high-pressure super-heated water ejected from the nozzle may remain in a liquid state after it exits the nozzle. In particular, it may remain in a liquid state at least 50 mm from the nozzle, in particular at least 60 mm from the nozzle, more particularly at least 70 mm, 75 mm or 80 mm from the nozzle. The pressure washer is configured to eject water from the nozzle at a pre-determined pressure and temperature, for instance 15, 16 or 17 MPa, as referred to above. As the water moves away from the nozzle the pressure will drop (dissipated in the atmosphere), but the temperature will remain substantially constant.

At a well-defined pressure, the high-temperature water will vaporize, approximately in line with the Antoine Equation:

[Math. In this way, the high-pressure super-heated water ejected from the nozzle may remain in a liquid state after it exits the nozzle. In particular, it may remain in a liquid state at least 50 mm from the nozzle, in particular at least 60 mm from the nozzle, more particularly at least 70 mm, 75 mm or 80 mm from the nozzle. The pressure washer is configured to eject water from the nozzle at a pre-determined pressure and temperature, for instance 15, 16 or 17 MPa, as referred to above. As the water moves away from the nozzle the pressure will drop (dissipated in the atmosphere), but the temperature will remain substantially constant.]

$$P=10^{A-B/(C+T)}$$

where P is the pressure at which the super-heated water will vaporize, T is the temperature of the super-heated water and A, B and C are constants given by A=8.14019, B=1810.94 and C=244.485 (for a temperature above 99 degrees and below 374 degrees); that is, P=10^(A−B/(C+T)). For example, at a temperature of 180 degrees, the vaporization pressure is approximately 0.997 MPa, at a temperature of 170 degrees, the vaporization pressure is approximately 0.787 MPa, and at a temperature of 160 degrees, the vaporization pressure is approximately 0.614 MPa.

In particular, the larger the aperture, the closer to the aperture will the pressure drop to a level below the vaporization pressure. Hence, by selecting a suitably sized nozzle, as suggested above, the effective range of the spray may be ensured to be greater than for instance 50 mm, 60 mm, 70 mm, 75 mm or 80 mm. Use at a distance above which the spray has vaporized is ineffective.

The pressure washer may further comprise a trigger for activation of the nozzle; that is, to select when a jet of super-heated water is to be produced. The trigger may be a mechanical trigger. A switch may determine when water is flowing through the nozzle, either directly via (for instance) a reed switch, or via detection of the state of actuation of the trigger. This switch may be activated by a magnet moving beside it whilst water is flowing; it may be returned away from the switch by a spring when the water stops flowing (trigger released). This switch may be arranged to control flow of fuel into the combustion chamber in combination with the temperature controller, for instance, the switch may be configured to activate (or allow the temperature controller to activate) the fuel valve to allow fuel flow when the boiler is below its selected temperature. In this way, the boiler may be prevented from heating water therein when no water is flowing through the nozzle.

The pressure washer may further comprise a generator, which may drive the pump and/or supply electricity to the boiler and/or controller.

The generator may comprise an engine (e.g. a diesel engine), the engine may be air-cooled, and/or the engine may be a 'pull-start' engine.

The generator may comprise an electrical generator. The electrical generator may be driven by the crank shaft of the engine, for instance via a vee belt pulley.

The electrical generator may be configured to generate 24 V DC electricity. The electrical generator may comprise two 12-pole permanent magnet generators. In this way, batteries and/or capacitors are not required to act as a 'reserve' or middle power source to excite an alternator. The output of each permanent magnet electrical generator may be approximately 27 V AC, approximately 400 Hz and/or approximately 300 W. Each output of the permanent magnet generators may be individually bridge rectified to DC (e.g. to approximately 24 V DC). The rectified outputs may be joined together in parallel to keep the same voltage but double the power (e.g. approximately 600 watts). The electrical output may be approximately 24 V DC, and may be up to 25 Amps. The electrical generators' output may be via a 16 Amp socket, which may be splash proof. The socket may be overload protected by a resettable fuse located adjacent to it.

The electrical output may be arranged to operate the boiler, in particular the temperature controller, and/or the pump valves. The boiler may be configured to operate on 24 V DC.

The engine may be run at a speed between 3000 and 5000 rpm, in particular between 3300 and 4000 rpm, more particularly between 3400 and 3700 rpm, for instance at approximately 3450 rpm; however, other configurations of engine are contemplated. The engine may produce an output of between 3 and 4 kW, in particular approximately 3.5 kW, when run at a speed of 3600 rpm.

The generator may comprise a reduction gearbox connected to the crank shaft. The reduction may be between 1.5:1 and 3:1, in particular between 2:1 and 2.5:1, for instance approximately 2.4:1. The gearbox may be bolted directly to the engine which keeps the assembly as one unit with no open drive. The pump may be driven by the crank shaft via the gearbox.

The diesel engine may be configured to be run close to its design load, as this conserves fuel compared to running a larger engine at, say, 50% load. Also, diesel engines can 'glaze up' the cylinder bores if the engine is subjected to light use.

By implementing all electrical components as 24 V DC, any one component may be easily replaced/substituted, independent of local electricity supply requirements.

The pressure washer may further comprise a frame mounted on wheels, within which the boiler is located; the frame may be a tubular frame.

The pressure washer may further comprise a generator frame, within which the generator is located; the generator frame may be a tubular frame. The generator frame may have feet (e.g. rubber feet) so it can be sat on the floor during use on its own as a cold pump, or during storage and transport. Because the generator is 24 V DC, it does not need grounding/earthing like higher voltage generators, thus we are not reliant on the metal frame being direct on the ground or a separate earth spike. The generator frame may comprise carry handles. The pressure washer may comprise attachment parts (e.g. hooks) on the frame or generator frame for enabling attachment of the generator frame to the frame, for instance by hanging.

The generator frame may also contain the pump therein.

The pressure washer may further comprise a fuel supply container, in which fuel for the engine/generator and/or boiler may be contained. The fuel supply container may comprise a jerry can, of for instance 20 litres. The fuel supply container may be removable; in particular, the pressure washer may comprise further attachment parts (e.g. hooks) on the frame or fuel supply container for enabling attachment of the fuel supply container to the frame, for instance by hanging.

The pressure washer may further comprise a pickup device that may be configured to lock into the neck of the jerry can, and may be configured to seal the jerry can to stop fuel contamination to the environment, but also to stop contamination into the fuel. A straw in the pickup may be configured to be clear of the bottom of the jerry can by approximately 20 mm to reduce the risk of picking up water. The straw may have a gauze on it to stop oversize sediment being picked up. The pickup may comprise a cartridge 'spin on' type filter that retains any smaller particulates. Between the fuel pump and the fuel filter may be connected a vacuum gauge, which may provide an indication of the condition of the fuel filter (i.e. whether it has become blocked). When the fuel gets to the pump it may be circulated back to the jerry can.

The fuel supply container may hang on an opposite side of the frame to the generator frame. The frame may comprise wheels having a spacing that allows the frame to balance when neither, one or other, or both of the fuel supply container and the generator frame is hung thereon. A stainless steel hose reeler can also be hung from the frame. Caster wheels may be located on a part of the frame spaced from the wheels, for instance on an upper portion of the frame, to take the weight of the pressure washer during loading and unloading by a single person in and out of a vehicle. The wheels may be pneumatic, and may be on stub axles so they can be individually removed by quick release. The pressure washer may comprise protective panels, which may be coupled via quick release for access for quick service or repair.

According to a second aspect of the present invention, there is provided a method of providing a super-heated jet of water, the method comprising the steps of: providing a pressure washer according to any preceding claim; providing at most 20 litres of water per minute at greater than 15 MPa; heating the pressurised water with a power of at least 75 kW to a temperature of at least 155 degrees centigrade; conveying the super-heated pressurised water to a nozzle; and producing a shaped liquid spray jet of super-heated water.

According to a third aspect of the present invention, there is provided a pressure washer, for providing a super-heated jet of water, the pressure washer comprising: a water pump configured to provide pressurised water to an output thereof; a boiler arranged to receive pressurised water from the output of the water pump, the boiler configured to heat the pressurised water to a temperature above 100 degrees centigrade; a hose for conveying the super-heated pressurised water from the boiler; an electrical generator configured to generate 24 V DC electricity; and an engine configured to drive the pump and the electrical generator; wherein the boiler is configured to operate with the 24 V DC electricity supplied by the electrical generator.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference FIGURES quoted below refer to the attached drawings.

FIG. 1 is schematic representation of the present invention.

DETAILED DESCRIPTION

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, FIGURE, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1 is schematic representation of a pressure washer for providing a super-heated jet of water from a nozzle 1, supplied by a hose 3. The pressure washer comprises a main unit composed of a frame 5 mounted on wheels 7. The frame 5 is provided with a handle 9 for effecting manual movement of the frame 5 and caster wheels 11 on an upper portion of the frame 5 to assist users in moving the pressure washer up slopes and/or steps. The frame 5 includes a boiler 13 therein, controlled via temperature controller 15 and supplied with fuel 17 from jerry can 19 via pickup 21. The boiler 13 heats water within a heat exchanger 23 before it is past to the hose 3 and thence to nozzle 1. The jerry can is supplied with a handle 24, and may optionally be attached to the frame 5.

Water 25 from reservoir 26 is supplied to the heat exchanger 23 via pump 27, operated by a pump controller 28. The pump 27 is housed within a further frame 29, which also includes a generator 31; specifically, an engine 33, gearbox 35 and electrical generator 37. The generator 31 drives the pump 27 via gearbox 35, and additionally drives the electrical generator 37, which supplies direct current electricity to the temperature controller 15, and optionally the pump controller 28. In alternative embodiments, the pump controller 28 is merely a set of manual controls. The frame is supplied with a carry handle 39, and may optionally be attached to the frame 5.

The invention claimed is:

1. A pressure washer, for providing a super-heated jet of water, the pressure washer comprising:

a water pump configured to provide at most 20 litres of water per minute at greater than 15 MPa to an output thereof;

a boiler arranged to receive pressurised water from the output of the water pump, the boiler configured to heat the pressurised water with a power of at least 75 kW to a temperature of at least 155 degrees centigrade;

a hose for conveying the super-heated pressurised water from the boiler, wherein the hose comprises a PTFE lining; and a nozzle connected to the hose and configured to produce a shaped liquid spray jet of super-heated water.

2. The pressure washer of claim 1, wherein the pump is configured to provide at most 9.5 litres of water per minute.

3. The pressure washer of claim 1, wherein the pump is configured to provide water at a pressure of at least 17 MPa.

4. The pressure washer of claim 1, wherein the boiler is configured to heat the pressurised water with a power of at least 90 kW.

5. The pressure washer of claim 1, wherein the boiler is configured to heat the pressurised water to a temperature of at least 170 degrees centigrade.

6. The pressure washer of claim 1, further comprising an electrical generator, and an engine configured to drive the pump and the electrical generator.

7. The pressure washer of claim 6, wherein the electrical generator is configured to generate 24 V DC electricity.

8. The pressure washer of claim 7, wherein the boiler is configured to operate with the 24 V DC electricity supplied by the electrical generator.

9. A method of providing a super-heated jet of water, the method comprising the steps of:

providing a pressure washer according to claim 1;

providing at most 20 litres of water per minute at greater than 15 MPa;

heating the pressurised water with a power of at least 75 kW to a temperature of at least 155 degrees centigrade;

conveying the super-heated pressurised water to a nozzle; and producing a shaped liquid spray jet of super-heated water.

* * * * *